United States Patent [19]

Schrepf et al.

[11] Patent Number: 4,861,179

[45] Date of Patent: Aug. 29, 1989

[54] MASCARA BRUSH

[75] Inventors: Volker Schrepf, East Islip, N.Y.; Franklin J. Hartel, Palmer, Mass.

[73] Assignees: Henlopen Manufacturing Co., Inc., Melville, N.Y.; Sanderson-Macleod, Inc., Palmer, Mass.

[21] Appl. No.: 279,808

[22] Filed: Dec. 5, 1988

Related U.S. Application Data

[62] Division of Ser. No. 837,523, Mar. 7, 1986.

[51] Int. Cl.[4] ..... A45D 40/26; A46B 11/00

[52] U.S. Cl. ..... 401/129; 401/118; 401/119; 132/218; 15/159 A; 15/206; 15/DIG. 6

[58] Field of Search ..... 401/118, 119, 129, 268, 401/290; 132/120, 216, 218, 320; 15/106, 114, 159 A, 167.1, 206, DIG. 6

[56] References Cited

U.S. PATENT DOCUMENTS

| | | | |
|---|---|---|---|
| 1,643,217 | 9/1927 | Lazarus | 15/167.1 X |
| 2,175,975 | 10/1939 | Steiner | 15/167.1 X |
| 2,342,833 | 2/1944 | Borgeat | 15/167.1 X |
| 2,931,366 | 4/1960 | Siegel | 15/206 |
| 3,103,679 | 9/1963 | Clemens | 15/159 A |

FOREIGN PATENT DOCUMENTS

| | | | |
|---|---|---|---|
| 2061024 | 6/1972 | Fed. Rep. of Germany | 15/159 A |
| 1134245 | 11/1956 | France | 15/DIG. 6 X |
| 934566 | 8/1963 | United Kingdom | 15/DIG. 6 X |
| 955778 | 4/1964 | United Kingdom | 15/159 A |
| 2171296 | 8/1986 | United Kingdom | 401/268 |

*Primary Examiner*—Richard J. Apley
*Assistant Examiner*—Franklin L. Gubernick
*Attorney, Agent, or Firm*—Chapin, Neal & Dempsey

[57] ABSTRACT

A spiral mascara brush including both soft bristles for applying mascara and stiff bristles for combing applied mascara through a user's eyelashes. The soft and stiff bristles are intermingled throughout the length of the brush in specified proportion so that the entire brush may be used both for applying the mascara and combing the eyelashes.

3 Claims, 1 Drawing Sheet

MASCARA BRUSH

This is a divisional application of our earlier copending application for "MASCARA BRUSH", Ser. No. 06/837,523, filed 3/7/86.

BACKGROUND OF THE INVENTION

This invention relates to spiral mascara brushes. As contemplated herein, a spiral mascara brush comprises a multiplicity of bristles each having opposed free ends, and means for fixedly mounting the bristles in a continuous spiral array such that the free ends of the bristles are disposed along a helix. Typically, the mounting means is an initially U-shaped wire, which is twisted into a tight, axially rectilinear helix (after the bristles have been positioned between the legs of the U) to grip the bristles firmly at their midsections and to spread them into the aforementioned spiral array. The bristle array, which may, for example, be cylindrical (having bristles of uniform length from base to tip of the brush) or conical (having bristles of progressively shorter length toward the brush tip), is dimensioned to be inserted within a mascara container, for immersion of the bristles in the contained mascara. The wire or other mounting means projects beyond the base of the bristle array and is commonly embedded in a plastic shank projecting axially from the interior of a mascara container cap, so that when the cap is mounted in closed position on a container, the brush is disposed inside the container with the bristles immersed as aforesaid. Brushes of this type are well known and widely used at the present day.

The conventional purpose of a spiral mascara brush is to apply mascara to a user's eyelashes, i.e. to pick up and transport mascara from the mascara container and to deposit the transported mascara on the eyelashes. For this purpose, the bristles must be soft (relatively low in flexural strength), because stiff bristles do not satisfactorily pick up, transport, and deposit mascara. An illustrative example of a bristle suitable for applying mascara is a nylon 6.12 fiber commercially available from E.I. dePont de Nemours & Co. under the trade name "TYNEX", having a diameter of 0.003 inch ±0.0005 inch ±15%.

Owing to its high viscosity, mascara, as applied to eyelashes, tends to deposit unevenly in the form of clumps. To achieve desired uniformity of distribution on the eyelashes, the applied mascara must be combed through the lashes. Mascara brush bristles soft enough to apply mascara, however, are too soft to comb eyelashes; when pressed against the lashes, they simply flex and do not penetrate the lashes as required to effect combing.

Accordingly, separate implements (e.g., toothed combs) have heretofore sometimes been provided for performing the combing function. The provision of two separate implements for applying and distributing or combing mascara is disadvantageous from the standpoint of cost and convenience to the user. Moreover, while a mascara-applying brush is protected (when not in use) by insertion in the closed mascara container, the second (combing) implement is not thus protected and may be exposed to contamination which can cause infections.

SUMMARY OF THE INVENTION

The present invention broadly contemplates the combination of soft bristles for applying mascara, and stiff bristles for combing the applied mascara, in a single spiral mascara brush. That is to say, in accordance with the invention, in a spiral mascara brush as defined above, the multiplicity of bristles constituting the brush consist essentially of a first quantity of bristles having a flexural strength adapted to apply mascara to a user's eyelashes and a second quantity of bristles having a flexural strength, substantially greater than the flexural strength of the bristles of the first quantity, adapted to comb applied mascara through a user's eyelashes. The term "flexural strength" as used herein, refers to resistance to bending; thus, a bristle of greater flexural strength is stiffer (less flexible) than a bristle of lesser flexural strength.

In this embodiment of the invention, the first (soft) and second (stiff) quantities of bristles are randomly intermingled throughout the length of the spiral array of bristles, each quantity being present in a proportion effective to perform its respective (applying or combing) function. It is found that both application and combing are satisfactorily performed when at least about 30% of the randomly intermingled bristles are first-quantity (soft, mascara-applying) bristles and at least about 10% of the bristles are second-quantity (stiff, eyelash-combing) bristles. Preferably, a majority of the total multiplicity of randomly intermingled bristles are first-quantity bristles.

The requisite difference in stiffness (flexural strength) between the bristles of the first and second quantities may be achieved by using bristles of different diameters and/or different materials. Thus, the bristles of both quantities may be nylon fibers, with the first-quantity bristles having a diameter of about 0.0025 inch and the second-quantity bristles having a diameter of about 0.006 inch. Again, the first-quantity bristles may be nylon fibers and the second-quantity bristles may be polyester fibers. If desired, the two quantities of bristles may also differ in color, to enable the user to recognize and distinguish them.

Further features and advantages of the invention will be apparent from the detailed description set forth below, together with the accompanying drawing:

DETAILED DESCRIPTION

Figure 1:
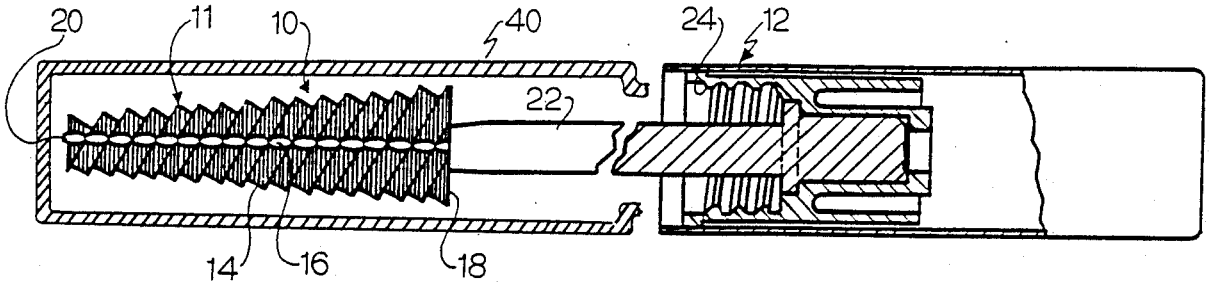
FIG. 1 is an enlarged fragmentary side view, partly in section, of a spiral mascara brush in which the present invention may be embodied.

Referring first to FIG. 1, there is shown a spiral mascara brush 10 including a brush head 11 and a cap 12 adapted to fit over and close the open top of a conventional mascara container (40). The brush head comprises a multiplicity of bristles 14 each having opposed free ends, and means 16 for fixedly mounting the bristles in a continuous spiral array such that the free ends of the bristles are disposed along an axially rectilinear open helix extending continuously from the base 18 to the tip 20 of the brush head.

In the form shown, the bristle-mounting means 16 is a metal wire having a midpoint located at the brush tip 20 and bent at that midpoint to provide two legs which are twisted together into a tight helix about a rectilinear axis coincident with the axis of the aforementioned open helix. The bristles of the brush are firmly gripped at their midsections between the twisted legs of the wire 16 so as to be held in the described spiral array, with the two ends of each bristle projecting equidistantly from the wire 16 in directions substantially perpendicular to the helix axis. The brush head is shown as having a conical configuration tapering toward the tip 20; i.e., the constituent bristles of the spiral array are of progressively shorter length toward the tip.

The helically twisted legs of the wire (mounting means) 16 extend for some distance beyond the base of the array of bristles. This bristle-free terminal portion of the wire is fixedly embedded in a plastic shank 22 which projects axially from the interior of the mascara container cap 12. An internally threaded skirt portion 24 of the cap concentrically surrounds the extremity of the shank remote from the bristles, in spaced concentric relation thereto, and opens toward the bristles. Thus, when the cap is threadedly mounted on the neck or open top of a mascara container, the shank 22 and wire 16 project downwardly through the container neck and the brush head 11, including the bristles 14, is entirely disposed inside the container, for immersion of the bristles in the contained mascara and protection of the brush head against contamination. The brush is, of course, appropriately dimensioned for such insertion as well as for application of mascara to a user's eyelashes. In one illustrative example, the length of the array of bristles (from tip 20 to base 18) is 1.250 inch, with a diameter of 0.375 inch at the base and 0.187 inch at the tip, and the overall length of the projecting brush, from the open end of the skirt 24 to the brush tip 20, is 3.340 inches.

As thus far described, the brush 10 is generally conventional, exemplifying spiral mascara brushes heretofore known and used to apply mascara to eyelashes. A conventional brush of this type, however, has a spiral array of bristles 14 constituted entirely of bristles of an essentially uniform flexural strength, which is sufficiently low for satisfactory performance of the operations of picking up mascara from a mascara container while the bristles are immersed therein, transporting the mascara from the container to a user's eyelashes, and depositing the transported mascara on the eyelashes. In contrast, in accordance with the present invention and as a particular feature thereof, the spirally arranged multiplicity of bristles 14 in the brush of the invention consists essentially of two sorts of bristles differing from each other in flexural strength, viz. a first quantity of bristles having a flexural strength adapted to apply mascara to a user's eyelashes and a second quantity of bristles having a different and substantially greater flexural strength adapted to comb the applied mascara through the eyelashes. For convenience, the first-quantity bristles will sometimes be referred to herein as "soft" bristles and the second-quantity bristles will sometimes be referred to herein as "stiff" bristles.

Figure 2:
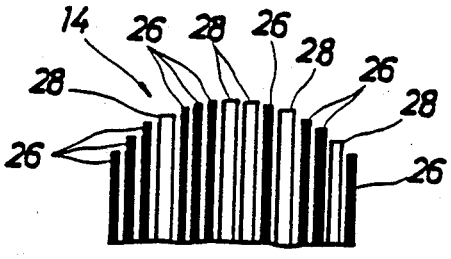
FIG. 2 is a further enlarged fragmentary schematic view of a portion of the spiral array of bristles in a mascara brush embodying the invention in a particular form.

As best illustrated in FIG. 2 (which is a simplified schematic representation of a fragmentary portion of one turn of the spiral array of bristles 14 as seen from the same view direction as FIG. 1), in one embodiment of the invention the soft and stiff bristles are randomly intermingled throughout the entire length of the spiral array. More particularly, the soft or first-quantity bristles 26 (shown as black bristles) are interspersed with stiffer or second-quantity bristles 28 (shown as white or neutral-colored bristles), each quantity of bristles being present in a proportion effective to perform its respective (applying or combing) function. The desired results are achieved when at least about 10% of the total number of bristles present in the spiral array are stiff bristles 28 and the balance are soft bristles 26 whereby, as indicated in FIG. 2, the majority of the bristles are soft bristles. Stiff bristles in the range of 10%–30% have been found to provide good results for most mascara applications and the best results have been achieved when approximately 30% of the bristles are of the stiffer variety.

The bristles of both quantities may be fabricated of the same material but may differ in diameter to provide the requisite respective flexural strengths, the soft bristles being smaller in diameter than the stiff bristles. By way of example, the soft bristles 26 may be made of nylon, with an individual bristle diameter of 0.0025 inch, and the stiff bristles 28 may likewise be made of nylon, but with an individual bristle diameter of 0.006 inch. Instead of (or in addition to) differing in diameter, the soft and stiff bristles may be made of respectively different materials which, for a given bristle diameter, have respectively different flexural strengths; thus, as a further example, the soft bristles may be nylon fibers of 0.0025 inch diameter and the stiff bristles may be polyester fibers of the same (or greater) diameter.

The brush of the invention, in the embodiment of FIG. 2, is used in much the same way as a conventional spiral mascara brush. Ordinarily, it is enclosed within a mascara container, with the array of bristles 14 (i.e., including both bristles 26 and bristles 28) immersed in the mascara and the cap 12 threaded in closed position on the neck of the container. When the cap is unscrewed and removed, withdrawing the brush from the container, mascara is transported on the brush (predominantly by the soft bristles 26), and is deposited therefrom onto the user's eyelashes as the brush is brought manually into contact with the eyelashes. Initially, the mascara may deposit as clumps, owing to its high viscosity, but as the brush is manipulated with a combing motion against the eyelashes the stiff bristles 28 comb through the eyelashes to distribute the applied mascara. Thereafter, the brush is reinserted into the mascara container and the cap is returned to container-closing position.

The brush 10 having randomly intermingled soft and stiff bristles thus serves both to apply the mascara and to distribute it by combing through the lashes, in an essentially unitary or integrated manipulative operation requiring only a single implement, which is protected by being enclosed in the mascara container when not in use. The presence of bristles of both kinds (soft and stiff) is essential to the attainment of these results, because bristles soft enough for satisfactory mascara application are too soft to provide effective combing action.

The soft and stiff bristles used in the various embodiments of the invention may be differentiated by color as well as by flexural strength, one exemplary color difference (black soft bristles, neutral or white stiff bristles) being represented in FIG. 2. This color differentiation initially indicates to the user that the brush is of the intermingled soft and stiff bristle type. Even though, in use, such color differentiation may be more or less obscured by mascara coating the brush, the initial indication assists the user in understanding how to manipulate the brush. In particular, when the brush is initially packaged outside the mascara container, i.e. for sale (with the container closed by a temporary cap), the color differentiation is clearly visible prior to the first insertion of the brush into the container.

Figure 3:
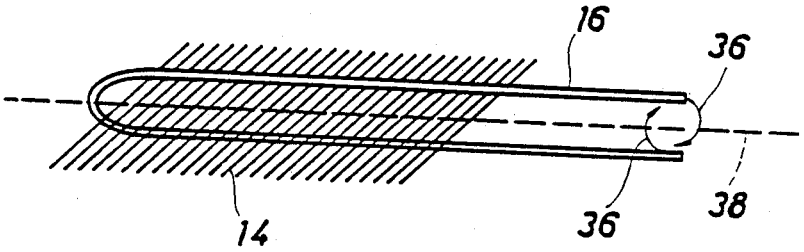
FIG. 3 is a schematic view in illustration of a method of making a brush embodying the invention.

Brushes embodying the invention may be manufactured in a generally conventional way, as illustrated schematically in FIG. 3, except for the inclusion (and appropriate relative positioning) of both soft and stiff bristles in the bristle feed. The wire 16 is initially in the form of a U between which the bristles 14 are fed transversely; then the legs of the wire are twisted (arrows 36) about longitudinal axis 38 to grip the midsections of the bristles and spread the bristles into the spiral array of FIG. 1. The bristles as fed between the wire legs include soft and stiff bristles randomly intermingled to produce the brush.

It is to be understood that the invention is not limited to the features and embodiments hereinabove specifically set forth, but may be carried out in other ways without departure from its spirit.

Having thus described our invention, what is claimed is:

1. A spiral mascara brush in combination with a container of mascara, said brush comprising (a) a multiplicity of bristles each having opposed free ends, and (b) a twisted wire fixedly mounting the bristles in a continuous helical array such that the free ends of the bristles are generally disposed along a helix, wherein the improvement comprises (c) said multiplicity of bristles comprising (i) one type of relatively soft bristles having a flexural strength adapted to apply mascara to a user's eyelashes;

(ii) another type of relatively stiff bristles having a flexural strength, substantially greater than the flexural strength of said soft bristles adapted to comb applied mascara through a user's eyelashes, and (iii) both said soft and stiff bristles being randomly intermingled through out the length of said helical array.

2. A mascara brush as defined in claim 1, wherein at least about 10%–30% of said multiplicity of bristles are said stiff bristles and the remainder are said soft bristles.

3. A mascara brush as defined in claim 2, wherein approximately 30% of said bristles are stiff bristles.

* * * * *